US005129798A

United States Patent [19]

Crum et al.

[11] Patent Number: 5,129,798

[45] Date of Patent: Jul. 14, 1992

[54] CO-ROTATIONAL SCROLL APPARATUS WITH IMPROVED SCROLL MEMBER BIASING

[75] Inventors: Daniel R. Crum; Peter A. Kotlarek, both of La Crosse, Wis.; George W. Brandt, Tyler, Tex.; Gene M. Fields, Frankston, Tex.; Joe T. Hill, Whitehouse, Tex.; John R. Williams, Tyler, Tex.; Robert E. Utter, Whitehouse, Tex.

[73] Assignee: American Standard Inc., New York, N.Y.

[21] Appl. No.: 654,437

[22] Filed: Feb. 12, 1991

[51] Int. Cl.[5] ..... F01C 1/04; F01C 19/08

[52] U.S. Cl. ..... 418/55.4; 418/55.5; 418/57

[58] Field of Search ..... 418/55.4, 55.5, 57, 418/188

[56] References Cited

U.S. PATENT DOCUMENTS 3,600,114 8/1971 Dvorak et al. ..... 418/55.5
4,600,369 7/1986 Blain ..... 418/55.5
4,645,437 2/1987 Sakashita et al. ..... 418/55.5
4,969,630 9/1987 Sakata et al. ..... 418/55.5
4,993,928 2/1991 Fraser, Jr. ..... 418/55.5

*Primary Examiner*—John J. Vrablik
*Attorney, Agent, or Firm*—William J. Beres; William O'Driscoll; David L. Polsley

[57] ABSTRACT

In a co-rotational scroll apparatus having two interleaving scroll wraps secured to end plates rotating concurrently about parallel, non-concentric axes to produce a relative orbital motion, a scroll member including an annular biasing chamber formed in one scroll member end plate opposite the scroll wrap and a passage from one of the chambers formed by the scroll wraps for providing fluid to the chamber. The fluid exerts a force upon a pressure plate secured to the opposing scroll end plate and thereby acts to bias the scroll wraps into contact with the opposing scroll end plate. Seals are provided in the biasing chamber of the scroll end plate to ensure contact with the pressure plate of the opposing scroll member.

40 Claims, 8 Drawing Sheets

CO-ROTATIONAL SCROLL APPARATUS WITH IMPROVED SCROLL MEMBER BIASING

DESCRIPTION

1. Technical Field

This invention generally pertains to scroll apparatus and specifically to co-rotating scroll-type fluid apparatus having an annular chamber formed in one scroll member backplate for containing a fluid to exert a biasing pressure on a pressure plate member connected to the other respective scroll member.

2. Background Art

Scroll apparatus for fluid compression or expansion are typically comprised of two upstanding interfitting involute spirodal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or near contact, the flank surfaces of the other respective scroll wrap to form a plurality of moving chambers. Depending upon the relative orbital motion of the scroll wraps, the chambers move from the radial exterior end of the scroll wraps to the radially interior ends of the scroll wraps for fluid compression, or from the radially interior end of the respective scroll wraps for fluid expansion. The scroll wraps, to accomplish the formation of the chambers, are put in relative orbital motion by a drive mechanism which constrains the scrolls to relative non-rotational motion. The general principles of scroll wrap generation and operation are discussed in numerous patents, such as U.S. Pat. No. 801,182.

Numerous attempts have been made to develop co-rotational scroll apparatus. Such apparatus provides for concurrent rotary motion of both scroll wraps on parallel, offset axis to generate the requisite orbital motion between the respective scroll wrap elements. However most commercially successful scroll apparatus to date have been of the fixed scroll-orbiting scroll type due to various difficulties in achieving success with co-rotating scroll apparatus.

Typically, a number of rotary bearings are required in a co-rotational scroll apparatus, which decreases the reliability and efficiency of the machine. Furthermore, the typical co-rotating scroll apparatus have required a thrust bearing acting upon each of the scroll end plates to prevent axial scroll separation, thus substantially increasing the power requirements of the machine as well as substantially reducing the reliability of the machine.

An additional problem which must be dealt with in scroll apparatus, whether used for compression or decompression of fluid, are the forces which result from the fluid trapped in the chambers formed in the scroll wraps. These forces include an axial separation force component resulting from the fluid pressure upon the scroll element end plates and a radial separation force resulting from the fluid pressure upon the scroll wraps themselves.

The separation forces due to the fluids compressed within the scroll elements vary cyclicly as the scroll elements rotate. This cyclic variation is a function of two factors. The first is the instantaneous location of the compression chambers formed by the scroll wraps during each revolution with respect to the center of the scroll element. As the scroll wraps orbit, the center of the compression chamber moves either inward or outward with respect to the axis of the scroll members. The second factor is the actual pressure of the compressed fluid, which also varys according to the instantaneous location of the compression chamber in which the fluid is contained, decreasing from the inner ends of the respective scroll wraps to the outer ends thereof. Both these factors combine to produce a torque load or moment, the product of the instantaneous center of the compression chamber location and the instantaneous fluid pressure both in an axial direction and in a radial direction, at that location. The resulting net moment upon the scroll member is the net effect of the torque loads developed in each compression chamber. The net torque load acts perpendicularly to the axis of rotation of the scroll member to cause the tipping of the scroll element. Since the tipping is more pronounced at various points during the rotation of the scroll element, and may not occur at some points, it is observable as a rocking or nutation of the scroll member during rotation.

Typically, this is dealt with by the provision of an axial force acting to compress the end plates of the scroll elements together, in opposition to the separating fluid forces and by the provision of relatively larger bearings. These compressive axial forces are typically induced either mechanically by such means as thrust bearings or springs, or by fluid pressure imposed upon the opposite side of the scroll end plate.

Prior scroll apparatus typically deal with the axial separation effect and the nutation effect by simply increasing the axial force loading upon the scroll end plate until the axial components of the separation effects are overcome. Hence, there are often unnecessarily high pressures acting upon the scroll wrap tips during the scroll cycle with resulting unnecessary friction and wear as well as excessive power consumption and loss of overall efficiency as well as high axial loading which must be overcome during compressor startup.

Another typical response to these tipping or nutation causing moments is to increase the size of the bearings in the scroll apparatus until the effects of these moments are no longer observable. This solution, however, increases the friction and heat losses in the operating efficiency of the apparatus due to the increased size of the bearings, with concurrently increased initial cost due to the cost of larger bearings and larger motors to operate the apparatus, and increased maintenance costs.

One alternative technique in the co-rotational scroll apparatus is to provide an annular chamber in a chamber defining element which is attached to one scroll member and disposed opposite the other scroll member such that fluid in the chamber acts upon the scroll end plate to force the scroll end plates together. The fluid in the chamber is provided from one of the compression chambers via a passage through the scroll end plate subject to the force of the fluid. U S Pat. No. 4,600,369 issued Jul. 15, 1986 to Blain is representative of this approach.

One limitation arising from this approach is that the chamber defined in the chamber defining element must have a width equal at least to one orbit diameter of the scroll members plus the width of the vent passage, or the fluid will vent from the passage into the low pressure area surrounding the scrolls, resulting in a temporary loss of force on the scroll end plate and separation of the scroll wraps. This width is a critical dimension, in that the annular width and diameter of the chamber determines the area upon which the fluid pressure acts to produce the force exerted on the scroll end plate.

The provision of the chamber defining element also introduces other considerations. The chamber defining element must be of substantial thickness to accommodate the axial movement of the chamber seals, adding substantial mass to the scroll apparatus. The consequent increased inertial resistance requires a relatively more powerful motor. Also, since the provision of the chamber in the chamber element requires substantial additional machining, in that an entire component must be fabricated and extensively machined to close tolerances, the manufacturing time and expense of the scroll apparatus is increased. Furthermore, additional fluid routing must be provided in the chamber element to direct the seals against the scroll end plate from which the fluid is directed. The fluid is transferred from the pressure chamber and therefore acts upon the seals at the pressure of the fluid in the pressure chamber.

Therefore it is an object of the present invention to provide a co-rotational scroll apparatus having improved fluid pressure biasing of the scroll elements.

It is a further object of the invention to provide a co-rotational scroll apparatus as will require a minimum of machining and fabrication by modification of one scroll element.

It is yet a further object of the present invention to provide such a co-rotational scroll apparatus as will be simply and inexpensively implemented.

It is another object of the present invention to provide such a co-rotational scroll apparatus as will permit the application of selective fluid pressure to the seal elements.

SUMMARY OF THE INVENTION

The subject invention is a co-rotational scroll apparatus in which one scroll element is modified to provide a pressure chamber. In the preferred embodiment, seals are provided which engage a pressure plate secured to the other scroll member to enclose the pressure chamber. Fluid enters the pressure chamber through one or more passages from a compression chamber to provide the desired pressure to bias the pressure plate away from the scroll element and thereby bias the scroll elements together.

Alternative embodiments are also provided in which the seal elements operate in chambers exposed to a selected pressure transmitted through a separate passage, and in which the seal elements are replaced by a piston element directly exposed to the pressure in the pressure chamber and acting in turn upon the pressure plate.

An exemplary co-rotational scroll apparatus which may suitably employ the subject invention is also presented.

DESCRIPTION OF THE PREFERRED EMBODIMENT

Figure 1:
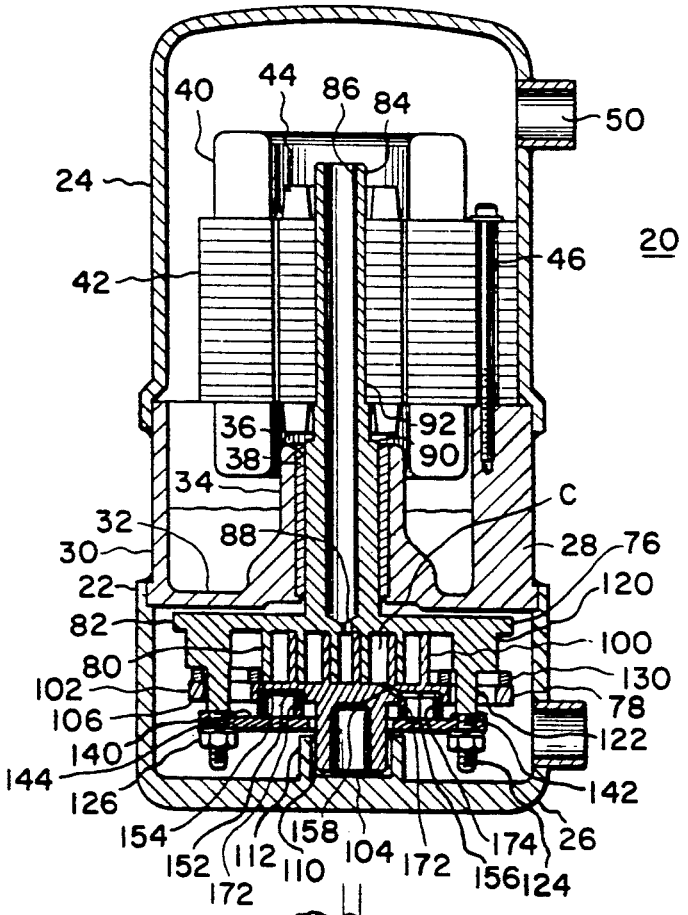
FIG. 1 discloses a cross-sectional view of a co-rotational scroll apparatus embodying the subject invention.
Figure 2:
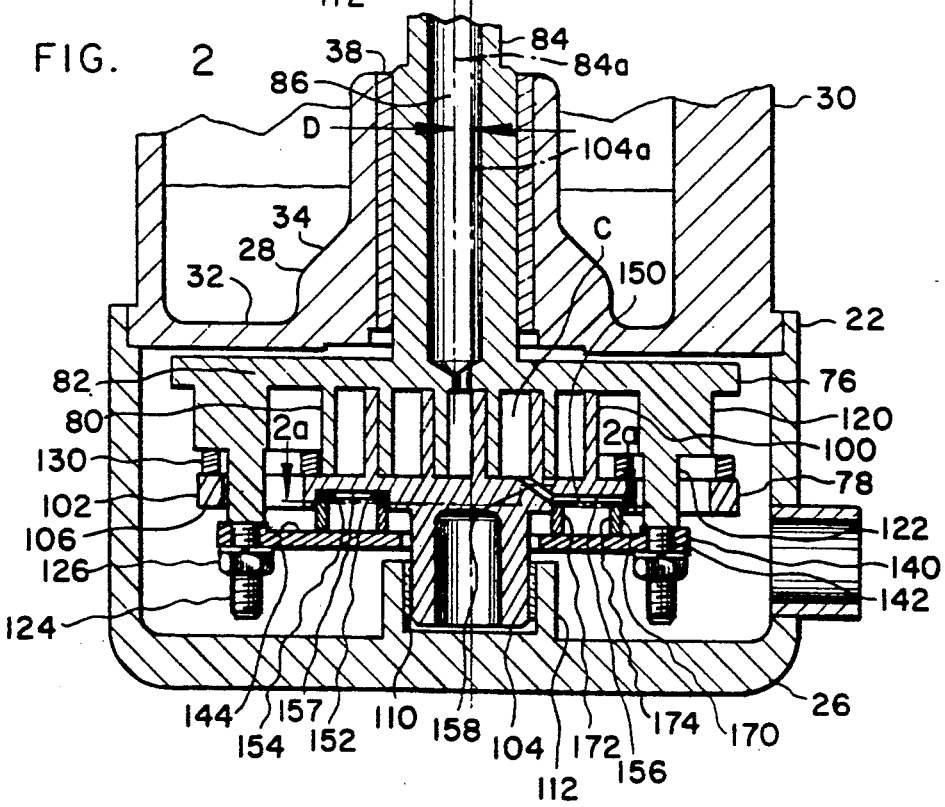
FIG. 2 is an enlarged partial cross-sectional view of the scroll apparatus of FIG. 1.

A scroll type fluid apparatus generally shown in FIG. 1, and FIG. 2 as a scroll compressor assembly is referred to by reference numeral 20. As the preferred embodiment of the subject invention is a hermetic scroll compressor assembly the scroll apparatus 20 is interchangeably referred to as a scroll compressor 20 or as a compressor assembly 20. It will be readily apparent that the features of the subject invention will lend themselves equally readily to use in a scroll apparatus acting as a fluid expander, a fluid pump, or to scroll apparatus which are not of the hermetic type.

In the preferred embodiment, the compressor assembly 20 includes a hermetic shell 22 having an upper portion 24, a lower portion 26, and an intermediate, central frame portion 28 affixed between the upper portion 24 and lower portion 26. The central frame portion 28 is defined by a generally cylindrical or annular exterior portion 30 and a central portion 32 disposed across one end thereof.

Integral with the central frame portion 28 is a generally cylindrical upper bearing housing 34, which is substantially coaxial with the axis of the annular exterior portion 30 A drive shaft aperture 36 extends axially through the center of the upper bearing housing 34, and an upper main bearing 38 is disposed radially within the drive shaft aperture 36. Preferably, the upper main bearing 38 is made, for example, of sintered bronze or similar material, but may also alternatively be a roller or ball-type bearing, for accepting a rotating load therein.

A motor 40 is disposed within the upper portion 24 and central frame portion 28 of the hermetic shell 22. The motor 40 is preferably a single-phase or three-phase electric motor comprised of a stator 42 which is circumferentially disposed about a rotor 44, with an annular space formed therebetween for permitting free rotation of the rotor 44 within the stator 42 as well as the flow of lubricant or refrigerant fluid.

It will be readily apparent to those skilled in the art that alternative types of motors 40 and means of mounting motor 40 would be equally suitable for application in the subject invention. For example the stator 42 could be secured within the scroll apparatus 20 by a plurality of long bolts or cap screws 46 provided through appropriate apertures in the stator plates into threaded apertures in the central frame portion 28 for securing the motor 40 within the hermetic shell 22.

The scroll arrangement includes a first or drive scroll member 76 and a second or idler scroll member 78, each having an upstanding involute scroll wrap for interfitting engagement with the other respective scroll wraps. The first scroll member 76 includes an upstanding first involute scroll wrap 80 which is integral with a generally planar drive scroll end plate 82. The drive scroll end plate 82 includes a centrally disposed first scroll member drive shaft 84 housing in axis 84*a* extending oppositely the upstanding involute scroll wrap 80. A discharge gallery 86 is defined by a bore extending centrally through the axis of the drive shaft 84. The discharge gallery 86 is in flow communication with a discharge aperture 88 defined by a generally central bore through the drive scroll end plate 82. The drive shaft 84 further includes a first, relatively large diameter portion 90 extending axially through the upper main bearing 38 for a free rotational fit therein and a second relatively smaller diameter portion 92 which extends axially through the rotor 44 and is affixed thereto. The rotor 44 may be affixed to the rotor portion 92 of the drive shaft 84 by such means as a press fit therebetween or a power transmitting key in juxtaposed keyways.

The second or idler scroll member 78 includes a second, idler scroll wrap 100 which is disposed in interfitting contact with the drive scroll wrap 80. The idler scroll wrap 100 is an upstanding involute extending from a surface of an idler end plate 102. Two rectilinear idler key stubs (not shown) extend upwardly on the idler end plate 102. The idler key stubs are disposed at radially opposed positions outside the idler scroll wrap 100. A centrally disposed second scroll member idler stub shaft 104 having an axis 104*a* extends from the back portion 106 of the idler end plate 102 oppositely the idler scroll wrap 100.

The axis 104*a* of the idler scroll is offset by a distance D from axis 84*a* of the drive scroll member to permit the concurrent rotation of the scroll members and the compression of gas therebetween. Back portion 106 of idler scroll member 78 includes a surface of end plate 102 which is opposite the surface on which scroll wrap 100 is disposed.

The designation of the drive scroll member 76 as the first scroll member and the idler scroll member 78 as the second scroll member must be understood as arbitrary, made for the purposes of ease of description and therefore not as a limitation. It would be equally accurate to designate the idler scroll member 78 as the first scroll member and the drive scroll member 76 as the second scroll member.

An annular bearing 110, which may be a sleeve bearing made of sintered bronze or other suitable material, or may be of the roller or ball type, is disposed within an annular wall defining an idler bearing housing 112 which is integral with the lower hermetic shell portion 26 as a support means for rotationally supporting the second or idler scroll member 78.

In the preferred embodiment, the drive scroll end plate 82 includes two radially opposed extension members 120 extending parallel the scroll wrap 80, and the idler scroll end plate includes two radially opposed idler key stubs extending parallel the scroll wrap 100, which are not visible in the cross-sectional views. The extension members 120 extend from positions near the outer periphery of the drive scroll end plate 82. The extension members 120 are also disposed at positions which are generally 90 degrees removed angularly from the positions of the idler key stubs when the scrolls 80 and 100 are in interleaving engagement. Each extension member 120 also includes a drive portion 122 and a tip portion 124 which is preferably threaded to accept a fastener 126.

A drive ring 130 serves as the means for engaging the drive portion 122 of the extension members 120 and the idler key stubs to ensure concurrent rotation of the scroll members 76 and 78. The drive ring 130 extends circumferentially about the scroll wraps 80 and 100 and includes four equally radially spaced slots which are slidingly engaged by the drive portions 122 and the idler key stubs, respectively. It is believed that the general construction and operation of the drive ring 130 is well understood by those skilled in the art, and therefore no detailed discussion is believed necessary. Also, it is believed that it will be apparent that there are other means available for insuring concurrent rotation of the drive scroll 76 and the idler scroll 78.

A planar or substantially planar pressure plate 140 having two radially opposed holes 142 is provided adjacent the back portion 106 of the second scroll member 78. The holes 142 are radially opposed so that the pressure plate 140 may be secured by the fasteners 126 to the extension members 120. It will be appreciated by those skilled in the art that while the pressure plate 140 is desirably planar, other configurations of the pressure plate 140 may be equally suitable where at least a portion including a planar surface 144 is provided. The planar pressure plate 140 is preferably formed of metal and is of simple manufacture, substantially enhancing the simplicity of manufacture of the scroll apparatus 20. It will also be appreciated that other suitable means for securing the pressure plate to the scroll member 76 are available and not limited to the use of extension members 120.

Figure 2B:
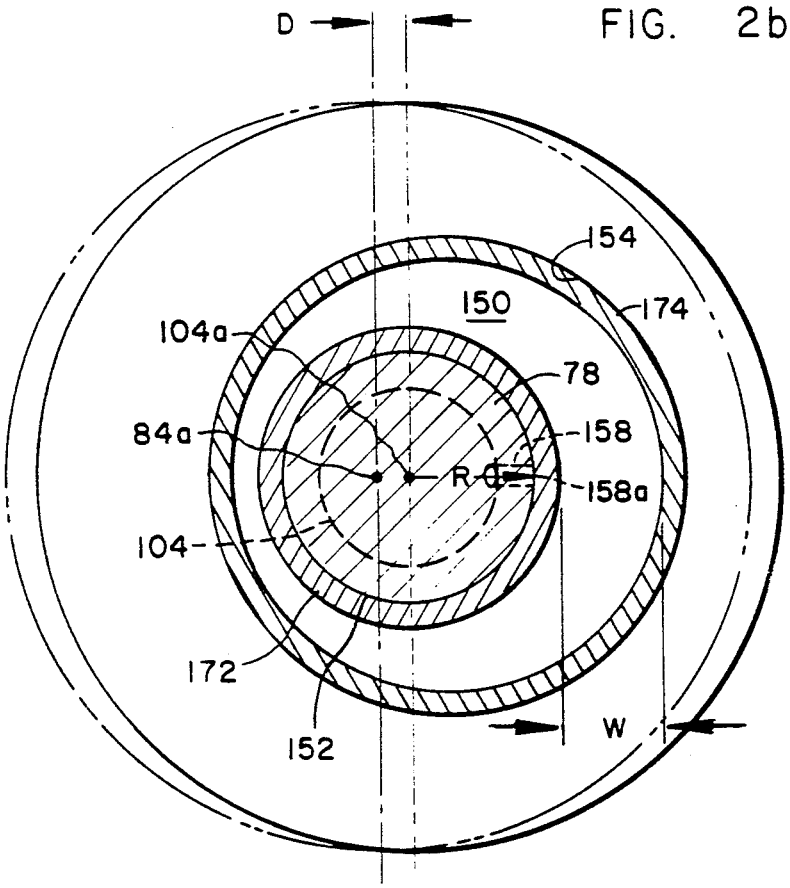
FIG. 2*b* is a view similar to FIG. 2*a* but illustrating an offset, noncentric pressure biasing chamber.
Figure 2C:
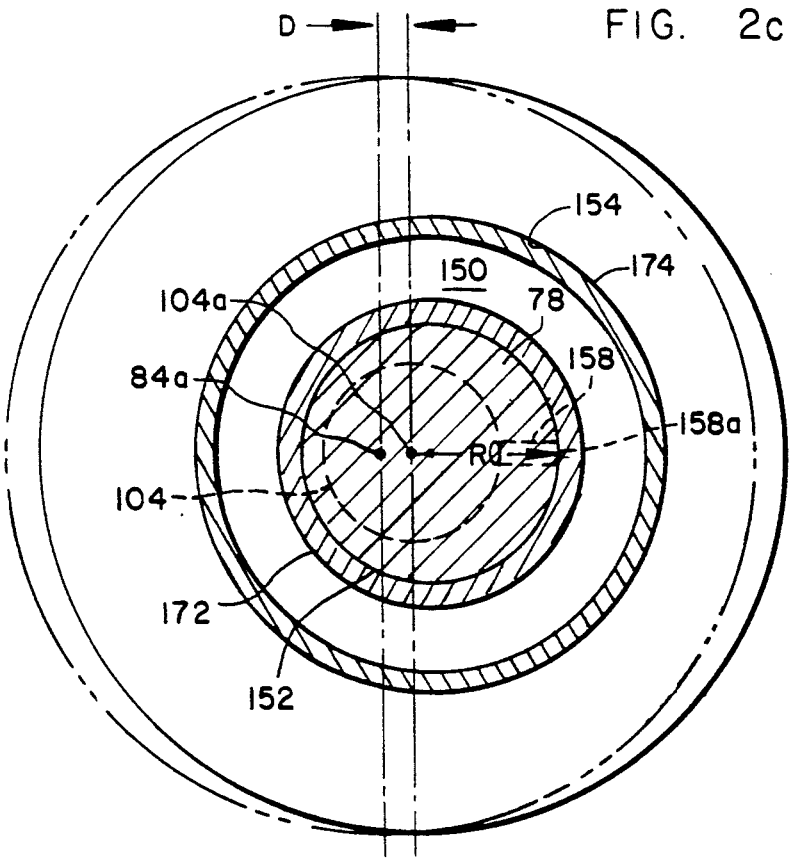
FIG. 2*c* is a view similar to FIG. 2*a* but illustrating an offset, concentric pressure biasing chamber.
Figure 2A:
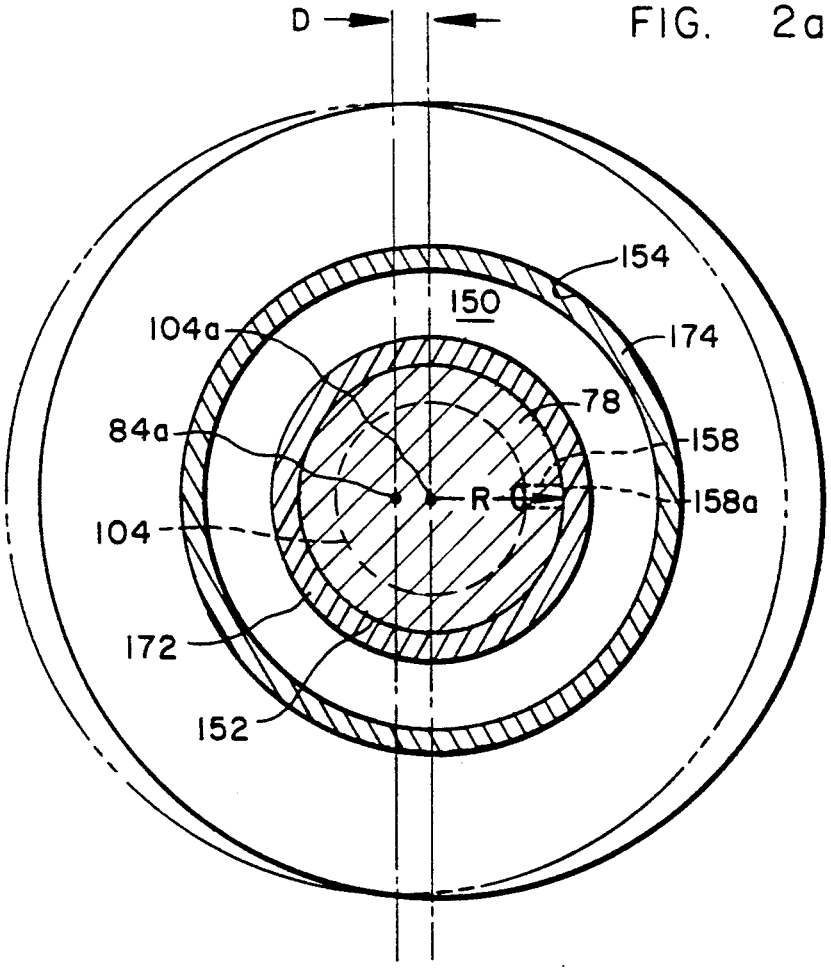
FIG. 2*a* is a view taken along lines 2*a*—2*a* in FIG. 2.

A pressure chamber 150 is provided in the back portion 106 of the second scroll member 78, as shown in FIG. 2 and FIG. 2*a*. This pressure chamber 150 is defined by an inner wall 152, an outer wall 154 an interior wall 156 which joins the inner wall 152 and the outer wall 154. Both the inner wall 152 and the outer wall 154 are perpendicular or substantially perpendicular to the back portion 106, being generally parallel to the axis of the scroll member 78 so that together with the interior wall 156 they define a recess 157 in the back portion 106. A fluid passage 158 is defined through the second scroll end plate 102 to permit fluid communication between the compression chamber C and the pressure chamber 150.

It will be appreciated, referring concurrently to FIGS. 2 and 2*a*, that passage 158 opens into recess 157 and therefore into pressure chamber 150 at a location which is at a fixed radius R from the axis 104*a* of the idler scroll member but which varies with respect to the axis 84*a* of the drive scroll member 76 due to the rotation of the two scroll members on axes which are offset from each other by a distance D. It will also be appreciated that fluid passage 158 opens into recess 157 at a fixed location both with respect to the recess and the seals which, as will further be described hereinbelow, are carried by idler scroll member 78. This arrangement is advantageous over the earlier arrangements discussed above because the location at which passage 158 opens into the pressure chamber is always assured to be in direct communication with both the pressure chamber 150 and the seals regardless of the compressor crank angle. If the fluid passage opening is permitted to move with respect to the seals and/or pressure chamber, as in the earlier arrangements discussed above where the seals are not carried by the idler scroll member or where the pressure chamber is defined in an element other than the idler scroll, there may be compressor crank angle positions where the fluid passage opening moves out of flow communication with the pressure chamber unless the pressure chamber is so wide as to accommodate the relative movement of the fluid passage opening with respect to the seals and/or pressure chamber. As was also mentioned above, pressure chamber width is a critical dimension because the larger the area acted upon by the pressure within the chamber, the more force is exerted on the scroll members. To the extent the force brought to bear exceeds that which is required for scroll member biasing purposes, it is detrimental to compressor efficiency and longevity. In the present invention, as opposed to the earlier arrangements discussed above, because the location at which passage 158 opens into chamber 150 is stationary with respect to the recess and seal elements, all of which cooperate in defining the pressure biasing chamber, and because the seal elements are carried by the idler scroll member, the pressure chamber can never be out of communication with the fluid passage which opens into the recess and the width of the chamber can be optimized so that the amount of biasing force brought to bear on the scroll set can be controlled and/or limited to minimize any compressor efficiency loss and wear which might otherwise result from the biasing arrangement.

Preferably, the inner wall 152 is circular and concentric with the shaft 104, and the second wall 154 is also circular and concentric with the shaft 104 of the scroll member 78 to provide a pressure chamber 150 of a suitable width.

As a result of the concentricity of the chamber 150 in the preferred embodiment with respect to shaft 104 of the idler scroll member and its axis, it will be appreciated that the center of pressure with respect to pressure in the chamber acting on the idler scroll member is always in line with the axis 104*a* of idler shaft 104. The present invention is therefore advantageous for still another reason over the earlier arrangements discussed above in that the force within pressure chamber 150, since it acts through the axis of the idler scroll member in the preferred embodiment, does not exert a tipping force on the idler scroll member. Such tipping or nutation of one scroll member with respect to the other is cause for leakage and wear within the compressor and degrades both compressor efficiency and bearing life. The fact that the seal elements, as will be discussed below, are carried by the idler scroll member and are preferably concentric with the axis of the idler shaft 104 therefore offers significant advantages for reasons which are not immediately apparent when earlier arrangements are considered. However, it is not necessary for either the first wall 152 or the second wall 154 to be concentric with the shaft 104, as is illustrated in FIGS. 2*b* and 2*c*, nor is it necessary that either the first wall 152 or the second wall 154 be circular. The radial spacing of the first wall 152 and the second wall 154 may be varied about the shaft 104 to provide a pressure chamber 150 which, as is illustrated in FIG. 2*c*, varies in width W at each radial position. This allows the width W of the pressure chamber 150 to be adapted to provide a lesser or greater force. and therefore a lesser or greater stabilizing torque or moment, due to the pressure of fluid in the pressure chamber 150 at those crank angle positions at which the scroll apparatus 20 is most likely to experience nutation due to nutation producing moments resulting from the compressed fluids within the compression chamber C. That is, by determining those crank angle positions at which idler scroll member 78 is subject to the greatest tipping forces due to the compression process which is occurring between the wraps of the scroll members, it is possible to advantageously offset the pressure chamber 150 with respect to the axis 104*a* of the idler scroll member to counteract such tipping forces. By offsetting the pressure chamber from the idler scroll axis, the biasing force created within pressure chamber 150 can be exerted other than through the axis of the idler scroll member. The biasing force can therefore, controllably and in a predetermined manner, by brought to bear in opposition to the tipping force exerted on the idler scroll member by the compression process so as to reduce the overall magnitude of the tipping force on the idler scroll member at predetermined crank angles. However, in the preferred embodiment, the pressure chamber 150 has a constant width W and is concentric with the shaft 104 for simplicity of manufacture A first seal element 172 is disposed in axial sliding engagement with the first wall 152 and a second seal element 174 is disposed in axial sliding engagement with the second wall 154. The seals 172 and 174 comprise a seal means 170 for sealing the pressure chamber 150. Preferably, the seals 172 and 174 are analagous to the annulus of a cylinder so that a cross-section thereof taken through the axis of the scroll apparatus 20 appears as rectangular. It is also desirable to form the seal means 170 of flexible material so that the pressure of fluid within the chamber will ensure a fluid tight contact between the respective wall and seal element. Also, the first and second seal elements 172 and 174 must be formed so as to permit reasonably free sliding engagement with the respective first and second wall surfaces 52 and 154 to permit axial movement of the pressure plate 140 with respect to the back portion 106.

In operation, the scroll apparatus 20, the motor 40 will be started, causing rotation of the first scroll member 76 and concurrent rotation of the second scroll member 78 through the drive ring means 130. The scroll wraps 80 and 100 will form a series of compression chambers C in which fluid will be compressed. Fluid will be forced from one compression chamber C through the fluid passage 158 into the pressure chamber 150. The pressure of the fluid in the pressure chamber 150 will force the seals 172 and 174 to engage the respective first and second walls 152 and 154 to form a fluid tight seal. The pressure of the fluid will also force the seals 172 and 174 away from the interior wall 156 and into sealing engagement with the planar portion 144 of the pressure plate 140. With the pressure chamber 150 thus closed the pressure of the fluid contained in the pressure chamber 150 will act to force the pressure plate 140 away from the back portion 106. This biasing of the pressure plate 140 will act through the extension members 120 to direct the first scroll members 76 toward the second scroll member 78, thus overcoming the axial separation forces generated within the compression chambers C and ensuring that the compression chambers C are closed and that fluid compression can occur therein.

It should be noted that when the same part or feature is shown in more than one of the figures, it will be labeled with the corresponding reference numeral to aid in the understanding of the subject invention. Furthermore, reference should be had to all of the figures necessary to aid in the understanding of the specification even where a particular figure is referred to, as all reference numerals are not displayed in all figures in order to minimize confusion. When the same part or feature appears in a figure representing or disclosing an alternative embodiment of that part or feature, it is labeled with the same reference numeral, followed by a numeric suffix to correspond with the designation of that alternative embodiment in the specification. The numeric designation of the alternative embodiment does not correspond to its preference but rather is intended to aid in the understanding of the subject invention.

Figure 3:
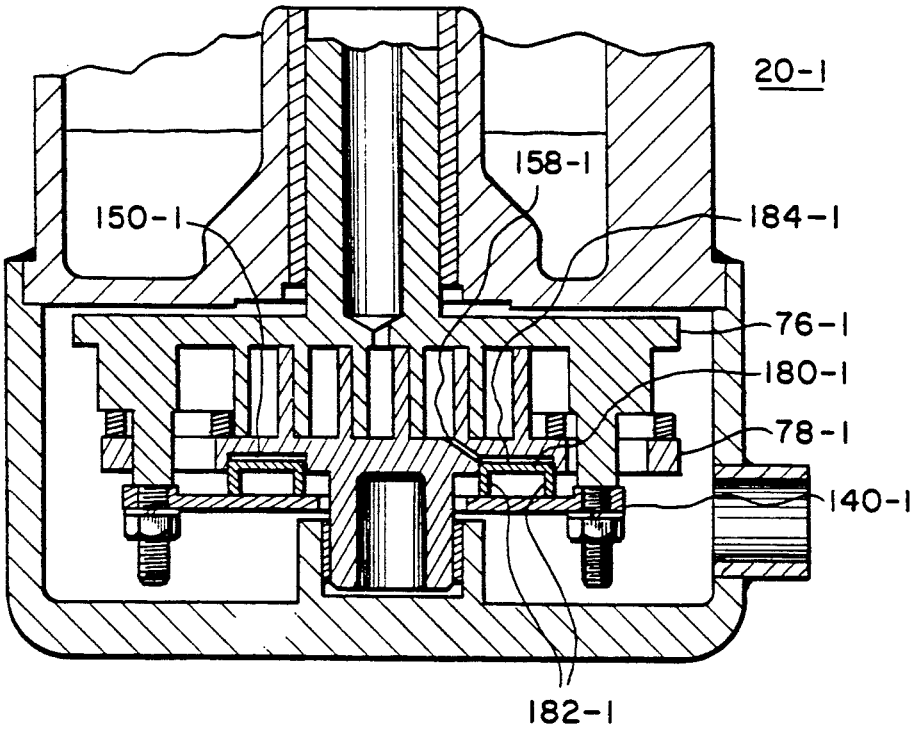
FIG. 3 is an enlarged partial cross-sectional view of an alternative embodiment of the scroll apparatus of FIG. 1.

Turning now to FIG. 3, a first alternative embodiment of the subject invention is disclosed. In the first alternative embodiment a piston element 180-1 is provided in lieu of the seal elements 172 and 174. The piston element 180-1 includes two downwardly extending legs 182-1 and a pressure surface 184-1, and is in sealing contact with the inner wall 152 and the outer wall 154. Other forms of the piston element 180.1 may be suitably employed and need not include the legs 182.1. In this alternative embodiment, the fluid from the compression chamber C is transferred through the fluid passage 158-1 into the pressure chamber 150-1, but acts on the pressure surface 184-1 of the piston element 180-1. This forces the piston element 180-1 against the pressure plate 140-1 and thus biases the scroll elements 76-1 and 78-1 as in the preferred embodiment. However, in this alternative embodiment there is no fluid pressure acting against the pressure plate 140-1 since the biasing force is transmitted by the piston element 180-1 In all other respects, the operation of the scroll apparatus 20-1 is identical with that of the preferred embodiment.

Figure 4:
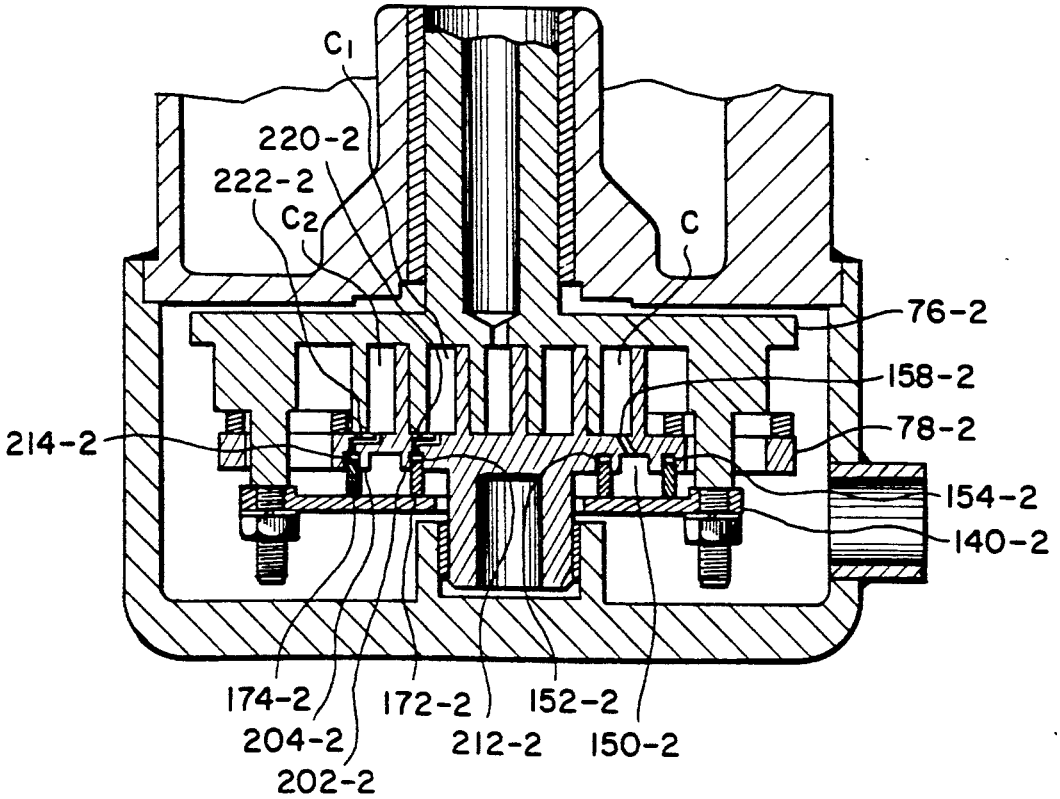
FIG. 4 is an enlarged partial cross-sectional view of a second alternative embodiment of the scroll apparatus of FIG. 1.
Figure 4A:
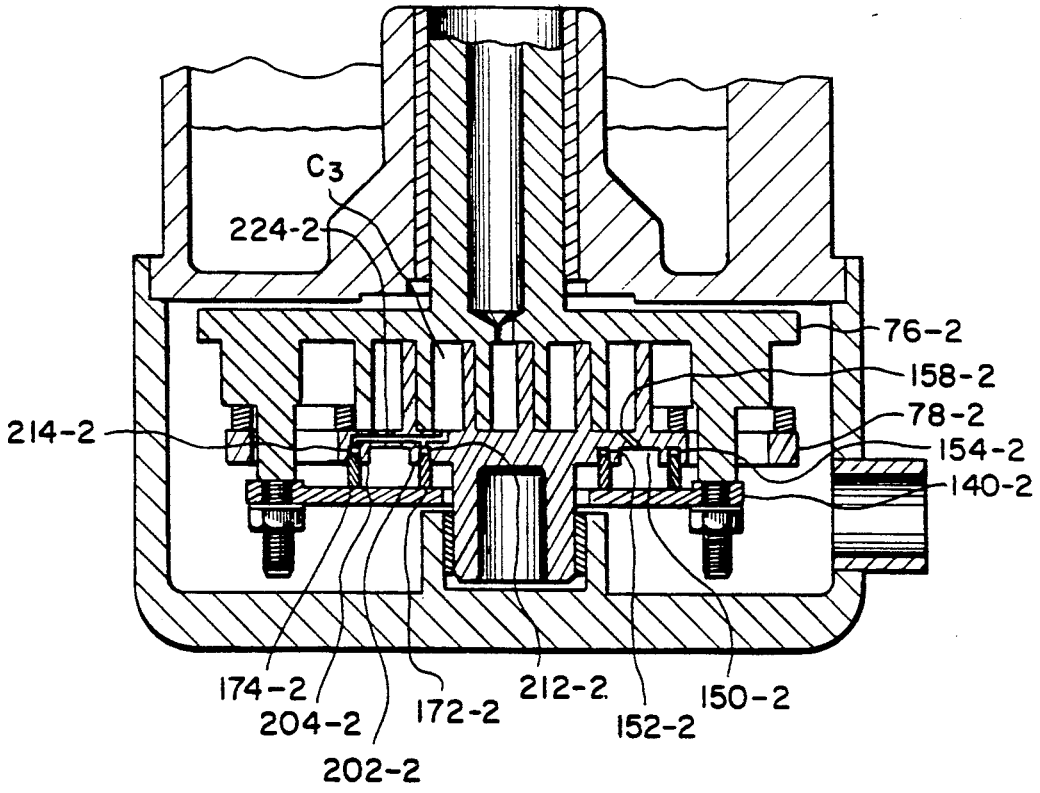
FIG. 4A discloses another embodiment of the second alternative embodiment of the scroll apparatus of FIG. 1.

Turning now to FIG. 4, a second alternative embodiment of the scroll apparatus 20-2 is disclosed. In this second alternative embodiment, a first seal retainer element 202-2 and a second seal retainer element 204-2 is provided The first seal retainer element 202-2 is spaced from the first wall 152-2 to form a first seal chamber 212-2 in which the first seal element 172-2 is disposed, and the second seal retainer element 204-2 is spaced from the second wall 154-2 to form a second seal chamber 214-2 in which the second seal 174-2 is disposed. The first seal chamber 212-2 and the second seal chamber 214-2 are sized to sealingly accept in sliding engagement the first seal member 172-2 and the second seal element 174-2, respectively. The first seal chamber 212-2 receives pressurized fluid through a first seal pressure passage 220-2, while the second seal chamber 214-2 receives fluid through a second seal pressure passage 222-2. In FIG. 4, the first seal chamber 212-2 receives pressure from a compression chamber C1 which is at slightly higher pressure than the pressure transmitted through the second seal passage 222-2 to the second seal chamber 214-2 from the compression chamber C2. Alternatively. as shown in FIG. 4A, both the first seal chamber 212-2 and the second seal chamber 214-2 may receive fluid through a common seal pressure passage 224.2 from a single compression chamber C3.

It will be apparent to those skilled in the art that because of the multitude of available pressures in the compression chambers C, each seal element 172-2 and 174-2 may be subjected to a pressure which is higher or lower or equal to the pressure contained in the pressure chamber 150-2 or the pressure to which the other respective seal element 172-2 or 174-2 is exposed. Therefore the foregoing description should be considered exemplary rather than limiting.

In operation, the second alternative embodiment is substantially identical to that of the preferred embodiment. As the scrolls 76-2 and 78-2 are rotated, the fluid in the respective compression chambers C will flow through the passages 158-2, 220-2 and 222-2 to provide the desired pressure in the pressure chamber 150-2, the first seal chamber 212-2 and the second seal chamber 214-2. Where the pressure in the seal chambers is lower than the pressure in the pressure chamber 150-2, the life of the seals 172-2 and 174-2 will be enhanced and on the other hand, where the pressure in the chambers 212-2 and 214-2 is greater than that in the pressure chamber 150-2, the seal elements 172-2 and 174-2 will be forced securely against the pressure plate 140.2 to ensure positive sealing of the pressure chamber 150-2. The fluid contained within the pressure chamber 150-2 then acts to bias the scroll elements together to enable the desired fluid compression.

According to the preferred embodiment and the alternative embodiments discussed in FIGS. 1–4, the scroll apparatus is disposed such that the axis of rotation is in a substantially vertical position. In the vertical position, gravity will act upon the seals 172 and 174 or the piston 180 to aid the sealing action thereof. This is especially important at time of startup of the scroll apparatus 20 since at startup the fluid pressure in the compression chambers C will often be equal to the suction pressure. In this condition, compressed fluid entering the pressure balance chamber 150 will attempt to seep between the seals 172 and 174, respectively, and the pressure plate biasing surface 144 before the fluid pressure exerted on the seals 172 and 174 is sufficient to ensure suitable sealing therebetween. Where the mass of the seals 172 and 174 is insufficient to ensure sealing action at startup, such seepage may occur and will prevent proper sealing of the pressure chamber 150. Improper sealing of the pressure chamber 150 may result in less efficient compression in the compression chambers C or may result in a lack of compression altogether.

Therefore, it is desirable in certain situations to provide means for biasing the seal means against the pressure biasing surface 144 to ensure that such seepage does not occur upon startup of the scroll apparatus 20. By way of illustration, sealing means including a biasing means 228 are disclosed in various drawing Figures. This is not intended to indicate that such biasing means are required for suitable operation of these alternative embodiments. Rather, those skilled in the art will understand that the application of such biasing means to the sealing means is dependent on a number of interrelated factors. These factors include the mass of the seals 172 and 174, the axial orientation of the scroll apparatus 20 and the resulting availability of gravity to ensure proper sealing, the fluid pressure to be contained within the pressure chamber 150 and the fluid pressure to be applied to the seal elements 172 and 174, and the magnitude of the axial separating force generated by the fluid in the compressions chambers C.

Figure 5:
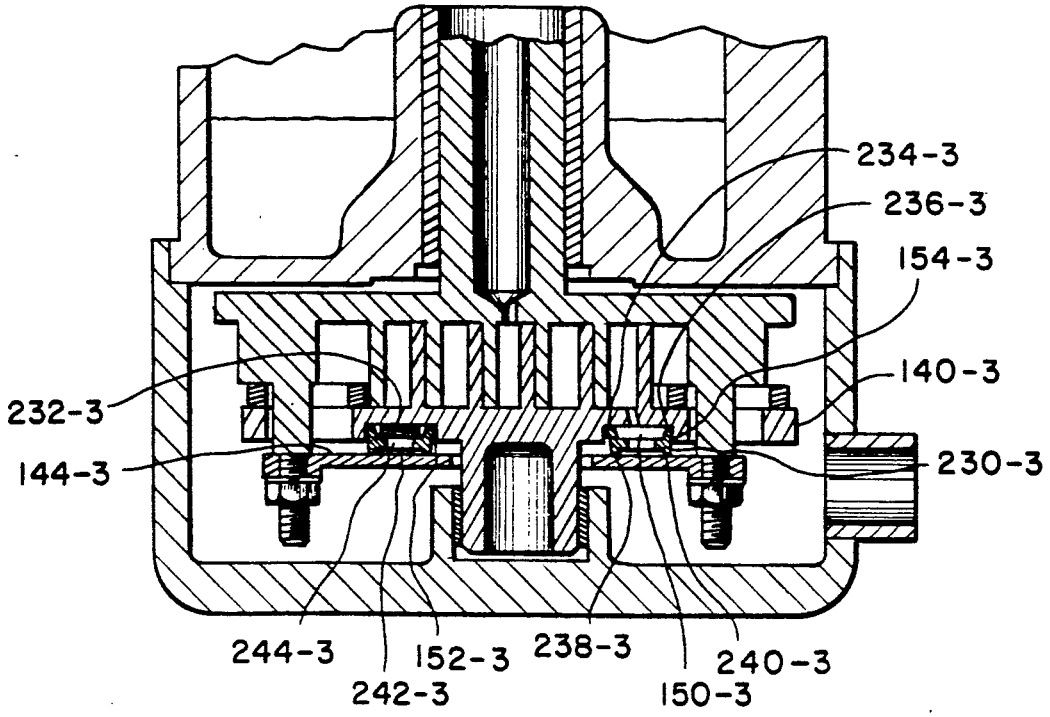
FIG. 5 discloses a third alternative embodiment of the scroll apparatus of FIG. 1.
Figure 5A:
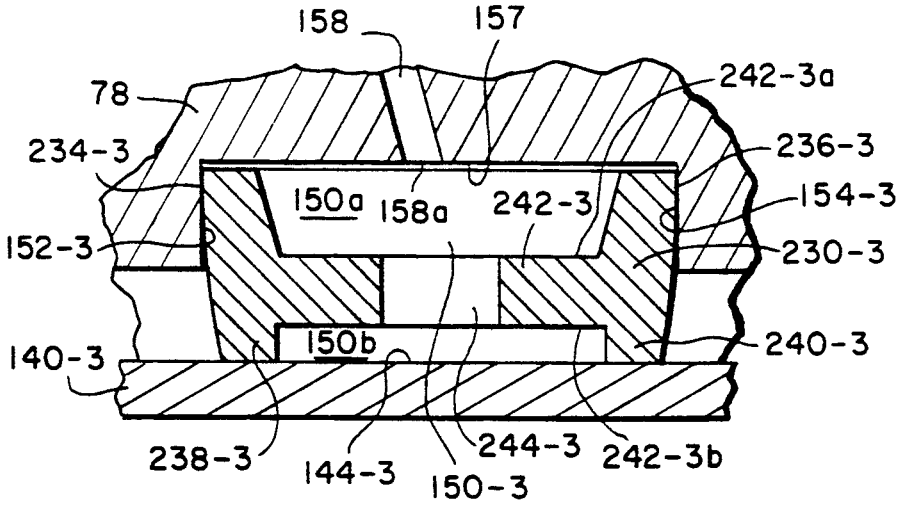
FIG. 5*a* is an enlarged partial view of FIG. 5 showing the seal element and pressure chamber thereof.

Turning now to FIG. 5 and FIG. 5*a*, a third alternative embodiment of the subject invention is disclosed. A single generally H-shaped seal element 230-3 serves as the seal means 170-3 and is biased against the pressure plate 140-3 by such an exemplary, optional spring biasing means 228 shown as coil springs 232-3, a number of which are disposed at relatively equal angular intervals. The seal element 230-3 includes four seal faces: an annular inner wall seal face 234-3 for sealingly engaging the inner wall 152-3, an annular outer wall seal face 236-3 for sealingly engaging the outer wall face 154-3 an annular inner seal tip 238-3 and an annular outer tip seal 240-3 disposed radially outward from the inner tip seal 238-3 with each of the seal faces in sliding engagement. A central web portion 242-3 connects and provides structural support for the seal faces 234-3, 236-3, 238-3 and 240-3. One or more fluid vents 244-3 are provided in the web portion 242-3 to permit the fluid in the pressure chamber 150-3 to contact the pressure plate surface 144-3. The inner tip seal 238-3 extends oppositely from the inner wall seal face 234-3 and the outer tip seal 240-3 extends oppositely from the outer wall seal face 236-3 for engaging the pressure plate surface 144-3.

In operation, the third alternative embodiment is similar to the preferred embodiment, varying only in that the seal tips 238-3 and 240-3 may not move independently. This assures that no undesirable radial displacement can occur which could cause loss of sealing of the pressure chamber 150-3 Furthermore, it will be noted that the annular inner wall seal face 234-3 and the annular outer wall seal face 236-3 can be formed so as to have a slightly greater width than the nominal width between the inner wall 152-3 and the outer wall face 154-3, where the material used to manufacture the seal is compliant. This ensures that the respective seal faces and walls will sealingly engage when assembled due to a preload or bias therebetween.

As is shown in FIG. 5, the width of seal tips 238-3 and 240-3 are preferably relatively narrow. This minimizes the force loading actually carried by the seal tips in engaging the pressure plate surface 144 to that necessary to assure sufficient sealing. Any increase in width of the seal tips above the necessary force loading results in increased friction with the pressure plate 140, with consequential reduction in seal life and power requirements upon the motor 40. This is true for the preferred embodiment as well, and for any alternatives in which fluid pressure is employed for biasing the pressure plate directly.

Coil springs 232-3 in FIG. 5, as earlier noted, are representative of seal biasing means 228 (illustrated in FIG. 5 as springs 232-3) and are optional. In this regard, it is noted, referring to FIGS. 2 and 5, that by limiting the size and/or number of fluid vents 244-3 therein, biasing means 228 (springs 232-3) can be dispensed with because by so limiting vents 244-3, a controlled and near immediate pressure build up in the area **150*a* of pressure chamber 150-3 between web portion 242-3 and scroll member 78 can be obtained at compressor startup. The pressure buildup in that area is due to the communication of initially compressed gas from compression chamber C through fluid passage 158 and fluid passage opening 158*a* to that area. Seal element 230-3 will, therefore, almost instantaneously be biased toward pressure plate 140-3 and scroll member 78 away therefrom so as to result in the rapid axial closure of the scroll set at compressor startup and the elimination of the need for optional biasing means 228 (springs 232-3). As will be apparent, the force carried by seal faces 238-3 and 240-3 of seal element 230-3 will, after rising to an initial peak at startup due to the large initial pressure differential across web portion 242-3, fall to a steady state condition as pressure equalizes across web 242-3 through vent holes 244-3 into area 150*b* which lies between web portion 242-3 and pressure plate surface 144-3. With respect to the steady state condition, it is noted that if the surface area 242-3*a* of the side of web portion 242-3 facing scroll member 78 is larger than the surface area 242-3*b* of the side of web portion 242-3 facing pressure plate surface 144-3, the force carried by seal faces 238-3 and 240-3 will be defined by the ratio of the areas of those two oppositely facing web surfaces. By controlling the size of the two surface areas of web portion 242-3, the force which acts through seal element 230-3 and through seal faces 238-3 and 240-3** to bias the drive and idler scrolls together during steady state operation can likewise be controlled.

Figure 6:
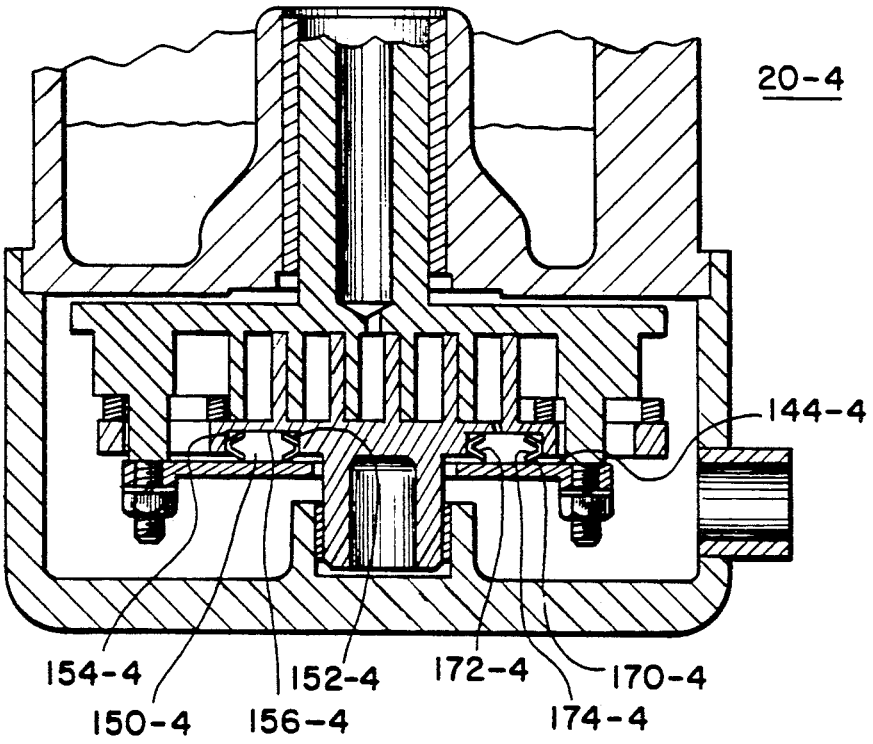
FIG. 6 discloses a fourth alternative embodiment of the scroll apparatus of FIG. 1

FIG. 6 discloses a fourth alternative embodiment of the scroll apparatus 20.4. In this embodiment, annular integrally spring-loaded seals 172-4 and 174-4, referred to as internal and external faceseals, are employed as the seal means 170-4. Such seals are typically U or V shaped in cross-section, with the base of the U or V oriented toward the respective pressure chamber wall 152-4 and 154-4, one arm of the U or V disposed in contact with the pressure chamber base 156-4 and the other in sealing engagement with the pressure plate surface 144-4. Pressure within the pressure chamber 150-4 will therefore operate to assist the sealing action of the seals One example of suitable faceseals which are commercially available is the series S60010, manufactured by American Variseal Corporation Operation of this embodiment is similar to the operation of the preferred and second alternative embodiments, where biasing means are employed to bias the sealing means. An advantage to this embodiment is that the biasing means is integral to the seal means, resulting in a reduction of the number of components required.

Figure 7A:
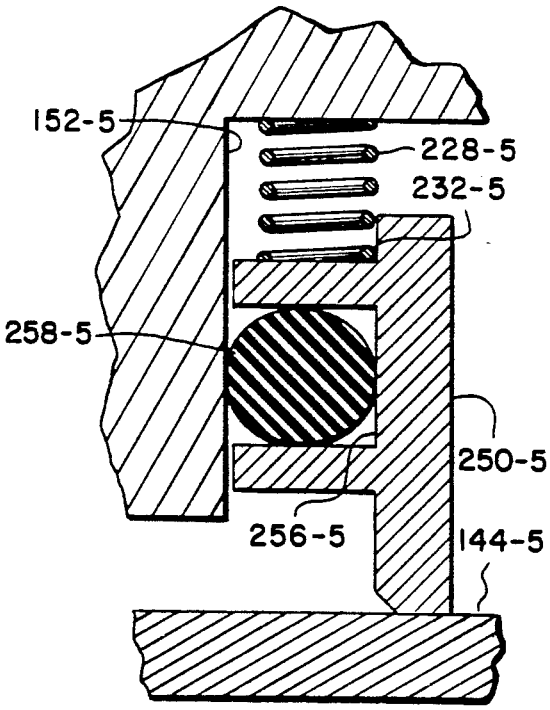
FIG. 7A is an enlarged partial cross-sectional view of the seal means of FIG. 7.
Figure 7:
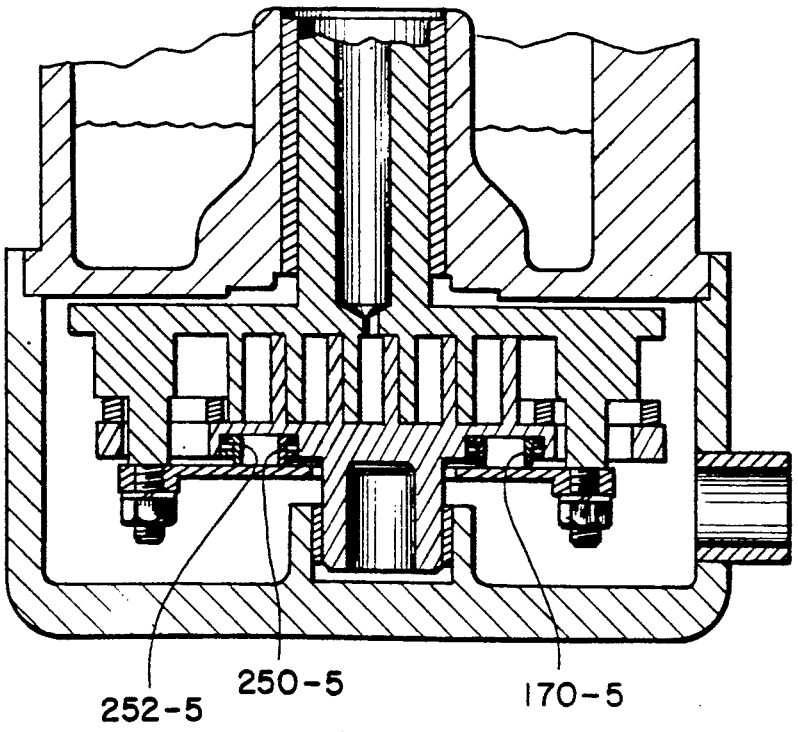
FIG. 7 discloses a fifth alternative embodiment of the scroll apparatus of FIG. 1

FIG. 7 discloses a fifth alternative embodiment of the scroll apparatus 20-5 in which annular tip seal members are employed. The seal means 170-5 includes an inner seal ring member 250-5 and an outer seal ring member 252-5. As seen in FIG. 7A, an enlarged partial cross-sectional view of the inner seal ring member 250-5 an intermediate seal channel 256-5 is formed in the inner seal ring member 250-5 adjacent the inner chamber wall 152-5 and an intermediate seal 258.5 is seated in the channel 256-5 to permit movement of the inner seal ring member 250-5 in the pressure chamber 150-5. A biasing means 228-5 such a coil springs 232-5 is also provided to engage the pressure chamber wall 156-5 and the inner seal ring member 250-5 to ensure contact between the pressure plate surface 144-5 and the inner seal ring member 250-5 Although not shown in enlarged detail, it can be seen in FIG. 7 that substantially the same features are provided in the outer seal ring member 252-5. This permits compliant movement of the inner seal ring member 250-5 and separate compliant movement of the outer seal ring member 252-5, which in this embodiment are formed from relatively inflexible material such as aluminum or steel.

Figure 4B:
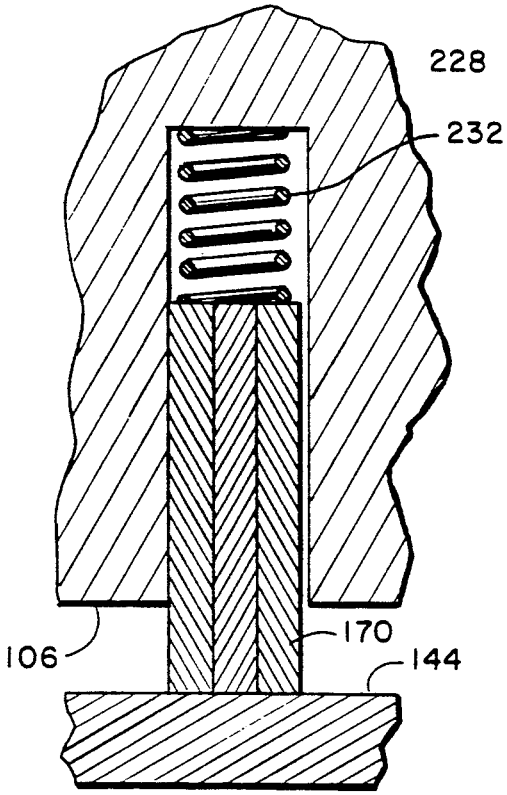
FIG. 4B discloses an alternative embodiment of the seal means of FIG. 4.
Figure 4C:
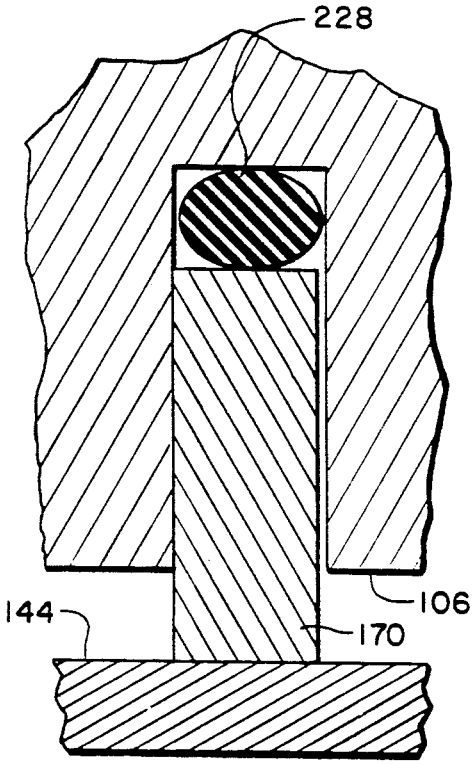
FIG. 4C discloses another alternative embodiment of the seal means of FIG. 4.
Figure 4D:
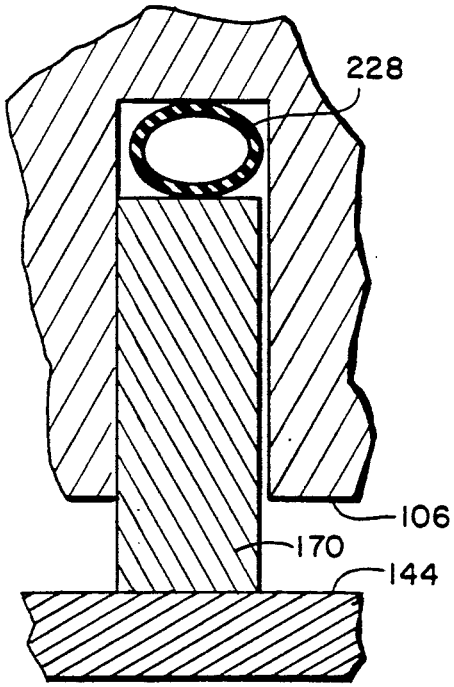
FIG. 4D discloses yet another alternative embodiment of the seal means of FIG. 4.

FIGS. 4B, 4C and 4D disclose in more detail exemplary biasing means 228, as applied for purposes of illustration only to the embodiment disclosed in FIG. 4.

In FIG. 4B, a seal means 170, composed of a laminate of materials such as spring steel or spring steel and rubber, is depicted. As with the seal element 230 in FIG. 5. a number of coil springs 232 are disposed to provide a force biasing the seal means 170 toward the pressure plate surface 144 In FIG. 4C, a flexible compressible element such as an O-ring is employed as the biasing means 228. Such O-rings are readily available commercially and provide an additional sealing capability. A canted coil spring disposed longitudinally along the seal means 170 is disclosed as the biasing means 228 in FIG. 4D. Those skilled in the art will recognize that other biasing means such as leaf springs or Bellville springs may be employed with equally suitable results.

Figure 8:
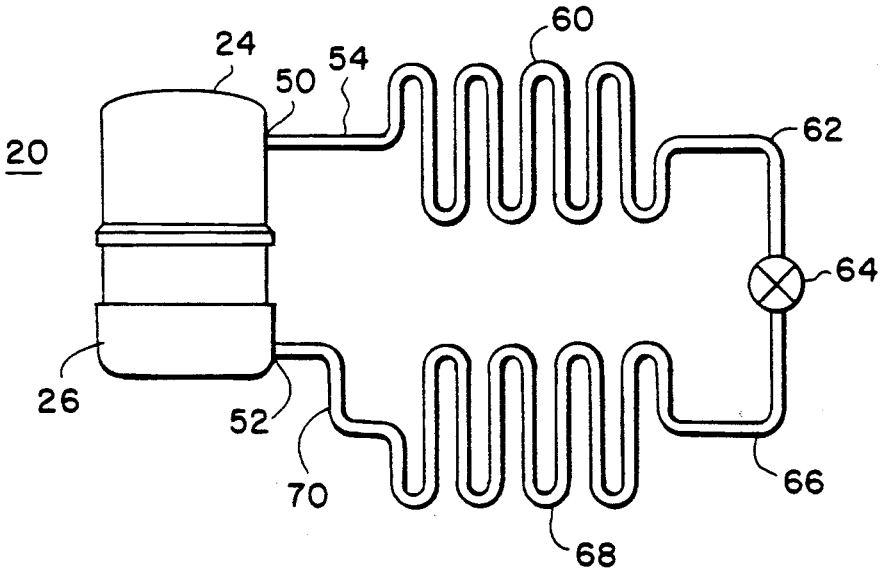
FIG. 8 discloses in schematic representation a refrigeration system employing the scroll apparatus according to the subject invention.

In FIG. 8, the scroll compressor assembly 20 is shown connected at the discharge aperture 50 in the upper hermetic shell portion 24 and the suction aperture 52 in the lower hermetic shell portion 26 to a fluid system such as generally is used in refrigeration or air conditioning systems. Those skilled in the art will appreciate that this is but one fluid system in which the scroll compressor assembly 20 could suitably be utilized, and that application of the scroll compressor assembly 20 in refrigeration and air conditioning systems is to be taken as exemplary rather than as limiting.

The refrigeration system, shown generally in schematic representation in FIG. 2 in connection with the scroll compressor assembly 20, includes a discharge line 54 connected between the shell discharge aperture 50 and a condenser 60 for expelling heat from the refrigeration system and in the process typically condensing the refrigerant from vapor form to liquid form A line 62 connects the condenser 60 to an expansion device 64. The expansion device 64 may be a thermally actuated or electrically actuated valve operated by a suitable controller (not shown), a capillary tube assembly, or other suitable means of expanding the refrigerant in the system. Another line 66 connects the expansion device 64 to an evaporator 68 for transferring expanded refrigerant from the expansion device 64 to the evaporator 68 for the acceptance of heat and typically the evaporation of the liquid refrigerant to a vapor form. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using suitably a scroll compressor apparatus 20 are well understood in the art, and that detailed explanations of the devices and mechanisms suitable for the operation and construction of such a refrigeration system need not be provided herein. It is believed that it will also be apparent to those skilled in the art that such refrigeration or air conditioning systems may include multiple units of the compressor assembly 20 in parallel or series type connection, as well as multiple condensers 60, evaporators 68, or other components and enhancements such as subcoolers and cooling fans and so forth as are believed known in the art.

In all respects, therefore, the subject invention represents a substantial improvement which reduces the initial cost and improves the overall efficiency of the scroll apparatus 20. Furthermore, although the subject invention is exemplified in a hermetic scroll compressor 20, it will be undoubtedly appreciated that the subject invention is useful in all applications of the co-rotational scroll apparatus 20, with like improvement in performance and reduction of expense.

Modifications to the preferred embodiments of the subject invention will be apparent to those skilled in the art within the scope of the claims that follow:

What is claimed is:

1. A co-rotational scroll apparatus comprised of:

a first scroll member having a first scroll end plate and a first scroll involute said first involute being disposed on a surface of said first scroll end plate;

a second scroll member having a second scroll end plate and a second scroll involute, said second involute being disposed on a surface of said second scroll end plate and cooperating with said first involute to define a compression chamber, said second scroll end plate defining a recess in a surface which is opposite said surface from which said second involute extends and further defining a passage from said compression chamber having an opening into said recess;

seal means carried by said second scroll member;

a pressure plate element secured to said first scroll member for rotation therewith, said pressure plate disposed adjacent said recess of said second scroll member and being in sliding engagement with said seal means, said recess, said seal means and said pressure plate cooperating to define a closed pressure chamber in flow communication with said compression chamber; and means for ensuring concurrent rotation of said scroll members.

2. The co-rotational scroll apparatus as set forth in claim 1 wherein said second scroll member includes a centrally disposed shaft, wherein said seal means are disposed in said recess and wherein said recess has a first wall radially spaced from said shaft and a second wall radially spaced from said shaft.

3. The co-rotational scroll apparatus as set forth in claim 2 wherein said first wall is circular.

4. The co-rotational scroll apparatus as set forth in claim 2 wherein said second wall is circular.

5. The co-rotational scroll apparatus as set forth in claim 2 wherein said first wall and said second wall are circular and concentric with said shaft.

6. The co-rotational scroll apparatus as set forth in claim 2 wherein at least one of said first wall and said second wall of said recess is nonconcentric with said shaft so that the pressure in said pressure chamber acts in opposition to the tipping force exerted on said second scroll member by the compression process occurring between the involutes of the first and second scroll members at a predetermined compressor crank angle so as to reduce the overall tipping moment experienced by said second scroll member at said predetermined crank angle.

7. The co-rotational scroll apparatus as set forth in claim 1 wherein said seal means divides said pressure chamber into first and second areas in flow communication through a vent hole and wherein said pressure plate includes a substantially planar portion, said first area being adjacent said opening into said recess and said second area being adjacent said planar portion of said pressure plate so that pressure communicated from said compression chamber through said passage to said pressure chamber initially builds in said first area and subsequently builds, at a rate controlled by the size of said vent hole, in said second area until the pressure in said first and said second areas equalizes.

8. The scroll apparatus as set forth in claim 2 wherein said seal means is further comprised of:

a first seal element disposed in said pressure chamber said first seal element in axial sliding engagement with said first wall; and a second seal element disposed in said pressure chamber, said second seal element in axial sliding engagement with said second wall.

9. The co-rotational scroll apparatus as set forth in claim 8 wherein said second scroll member end plate further defines;

a first seal retainer element spaced from said first circular wall to define a first seal chamber between said first seal retainer element and said first circular wall; and a second seal retainer element spaced from said second circular wall to define a second seal chamber between said second seal retainer element and said second wall.

10. The co-rotational scroll apparatus as set forth in claim 9 wherein said second scroll member end plate further defines a first seal pressure passage from said compression chamber to said first seal chamber.

11. The co-rotational scroll apparatus as set forth in claim 9 wherein said second scroll member end plate further defines a second seal pressure passage from said compression chamber to said second seal chamber.

12. The co-rotational scroll apparatus as set forth in claim 9 wherein said scroll apparatus further includes means for biasing said first seal element toward said pressure plate.

13. The co-rotational scroll apparatus as set forth in claim 9 wherein said scroll apparatus further includes means for biasing said second seal element toward said pressure plate.

14. The co-rotational scroll apparatus as set forth in claim 1 wherein said scroll apparatus further includes means for biasing said seal means toward said pressure plate.

15. The co-rotational scroll apparatus as set forth in claim 8, wherein said pressure chamber is nonconcentric with respect to said shaft so that the pressure in said pressure chamber acts in opposition to the tipping force exerted on said second scroll member by the compression process occurring between the involutes of the first and second scroll members at a predetermined compressor crank angle.

16. The co-rotational scroll apparatus as set forth in claim 15 wherein the width of said pressure chamber varies.

17. A co-rotational scroll apparatus comprised of:

a first scroll member having a first scroll end plate and a first scroll wrap disposed on a surface of said first scroll end plate;

a second scroll member having a second scroll end plate and a second scroll wrap disposed on a surface of said second scroll end plate, said second scroll wrap cooperating with said first scroll wrap to define a compression chamber, said second scroll end plate defining a recess in a surface of said end plate from which a centrally disposed shaft extends, said surface from which said shaft extends being a surface of said second scroll end plate opposite said surface on which said second scroll wrap is disposed, said second scroll end plate further defining a fluid passage from said compression chamber having an opening into said recess, said opening being stationary with respect to said recess;

a piston element disposed in said recess, said piston element being radially stationary with respect to said fluid passage opening;

a pressure plate element rotating with said first scroll member and being disposed adjacent said recess of said second scroll member in sliding engagement with said piston element, said recess, said piston and said pressure plate cooperating to define a closed pressure chamber, the center of pressure of said pressure chamber acting through the axis of said second scroll member shaft;

means for ensuring concurrent rotation of said scroll members.

18. The co-rotational scroll apparatus as set forth in claim 17 wherein said piston element further includes two legs extending therefrom, said legs in contact with said pressure plate.

19. The co-rotational scroll apparatus as set forth in claim 17 wherein said recess has first and second walls radially spaced from said shaft, said first wall and said second wall being circular and concentric with said second scroll shaft.

20. The co-rotational scroll apparatus as set forth in claim 17 wherein said pressure chamber is nonconcentric with respect to said shaft so that the pressure in said pressure chamber acts in opposition to the tipping force exerted on said second scroll member by the compression process occurring between the involutes of the first and second scroll members.

21. A co-rotational scroll apparatus comprised of:

a first scroll member having a first scroll end plate and a first scroll wrap disposed on a surface of said first scroll end plate;

a second scroll member having a second scroll end plate and a second scroll wrap disposed on a surface of said second scroll end plate for cooperating with said first upstanding involute portion to define a compression chamber, said end plate defining a recess and having a centrally disposed shaft on a surface of said second scroll end plate which is opposite the surface on which said second scroll wrap is disposed,, said recess having a first wall radially spaced from said shaft and a second wall radially spaced from said shaft, said second scroll end plate further defining a fluid passage from said compression chamber having an opening into said recess;

a pressure plate element secured to said first scroll member, said pressure plate disposed adjacent said recess defined by said second scroll member;

a seal element disposed in said second scroll end plate, said seal element being stationary with respect to said fluid passage opening and being in sealing engagement with said first and second wall, said seal element further being in sliding engagement with said pressure plate, said recess, said pressure plate and said seal element cooperating to define a closed pressure chamber in flow communication with said compression chamber;

means for ensuring concurrent rotation of said scroll members; and means for driving one said scroll member.

22. The co-rotational scroll apparatus as set forth in claim 21 wherein said seal element is generally "H"-shaped and has a web portion which defines a vent hole therethrough.

23. A co-rotational scroll apparatus comprised of:

a first scroll member having a first scroll end plate and a first upstanding involute portion disposed on said first scroll end plate;

a second scroll member having a second scroll end plate and a second upstanding involute portion for cooperating with said first upstanding involute portion to define a compression chamber, said second scroll end plate defining a recess in a surface of said end plate from which a centrally disposed shaft extends, said recess having a first wall radially disposed from said shaft and a second wall radially spaced from said shaft, said second scroll end plate further defining a fluid passage from said compression chamber to said recess;

a pressure plate element secured to said first scroll member, said pressure plate disposed adjacent said recess of said second scroll member;

an inner seal ring member disposed in said recess said inner seal ring member being in axial sliding engagement with said first wall and in sliding engagement with said pressure plate;

an outer seal ring member disposed in said recess, said outer seal ring member being in axial sliding engagement with said second wall and in sliding engagement with said pressure plate, said recess, said inner and outer seal ring members and said pressure plate cooperating to define a closed pressure chamber in flow communication with said compression chamber;

means for ensuring concurrent rotation of said scroll member; and drive means for rotating one of said scroll members.

24. The co-rotational scroll apparatus as set forth in claim 23 wherein said inner seal ring member further defines an intermediate seal channel in which an intermediate seal is disposed in sliding engagement with said first wall.

25. The co-rotational scroll apparatus as set forth in claim 23 wherein said recess is nonconcentric with respect to said centrally disposed shaft.

26. The co-rotational scroll apparatus as set forth in claim 23 wherein said outer seal ring member further defines an intermediate seal channel in which an intermediate seal is disposed in sliding engagement with said second wall.

27. The co-rotational scroll apparatus as set forth in claim 23 wherein the width of said recess varies.

28. The co-rotational scroll apparatus as set forth in claim 23 wherein said scroll apparatus further includes means for biasing said inner ring seal member toward said pressure plate.

29. The co-rotational scroll apparatus as set forth in claim 23 wherein said scroll apparatus further includes means for biasing said outer ring seal member toward said pressure plate.

30. Co-rotational scroll apparatus comprising:

first and second scroll members, each of said scroll members having an end plate and a scroll wrap extending from one side thereof, the scroll wraps of said first and said second scroll members interfitting with each other, said second scroll member defining a recess on the side of its end plate opposite the side from which said wrap extends;

bearing means for supporting said first and second scroll members;

means for linking said scroll members for concurrent rotation;

means, carried by said first scroll member, for defining a pressure responsive surface;

seal means operatively disposed in sealing engagement with said second scroll member and said pressure responsive surface to, in cooperation with said second scroll member and said pressure responsive surface, define a pressure chamber in flow communication with said recess; and an inlet to said recess for receipt of a fluid under pressure to act concurrently against said pressure responsive surface and said second scroll member so as to bias said second scroll member toward said first scroll member, said inlet being radially stationary with respect to said seal means.

31. The co-rotational scroll apparatus according to claim 30 wherein said seal means divides said pressure chamber into a first area adjacent said second scroll member and a second area adjacent said pressure responsive surface.

32. The co-rotational scroll apparatus according to claim 31 wherein said seal means has a central web portion.

33. The co-rotational scroll apparatus according to claim 32 wherein said central web portion defines at least one vent hole therethrough.

34. The co-rotational scroll apparatus according to claim 33 wherein said web portion has a surface facing said second scroll member and a surface facing said pressure responsive surface on said means carried by said first scroll member.

35. The co-rotational scroll apparatus according to claim 34 wherein the area of said web surface facing said second scroll member is greater than the area of said web surface facing said pressure responsive surface so that during operation of said scroll apparatus said seal element is biased toward said pressure responsive surface by a pressure which is determined by the ratio of the area of the web surface facing said second scroll member to the area of the web surface facing said pressure responsive surface.

36. The co-rotational scroll apparatus according to claim 35 wherein said seal means is a one piece seal element.

37. The co-rotational scroll apparatus according to claim 36 wherein said seal element has four sealing surfaces.

38. The co-rotational scroll apparatus according to claim 37 wherein two of said four sealing surfaces contact said pressure responsive surface.

39. The co-rotational scroll apparatus according to claim 38 wherein said pressure chamber defined by said second scroll member has inner and outer walls and wherein the other two of said four sealing surfaces of said seal element seal, one each, against different ones of said walls.

40. The co-rotational scroll apparatus according to claim 30 wherein said second scroll end plate has a shaft extending therefrom in a direction opposite the direction from which said second scroll wrap extends, said recess being nonconcentric with respect to said shaft.

* * * * *

UNITED STATES PATENT AND TRADEMARK OFFICE

CERTIFICATE OF CORRECTION

PATENT NO. : 5,129,798

DATED : July 14, 1992

INVENTOR(S) : Daniel R. Crum et al

It is certified that error appears in the above-indentified patent and that said Letters Patent is hereby corrected as shown below:

Column 4, Line 36, after "assembly insert -- , --.

Column 5, Line 18, "housing in" should read -- having an --.

Column 7, Line 65, the new paragraph should begin with "However".

Column 8, Line 25, "by" should read -- be --.

Column 8, Line 48, "52" should read -- 152 --.

Column 10, Line 2, "224.2" should read -- 224-2 --.

Column 10, Line 25, "140.2" should read -- 140-2 --.

Column 12, Line 23, "20.4" should read -- 20-4 --.

Column 12, Line 33, after the word "seals" insert -- . --

Column 12, Line 36, after the word "Corporation" insert -- . --.

Column 12, Line 51, "258.5" should read -- 258-5 --.

Column 13, Line 6, after "144" add -- . --.

Column 13, Line 32, after "form" add -- . --.

UNITED STATES PATENT AND TRADEMARK OFFICE

CERTIFICATE OF CORRECTION

PATENT NO. : 5,129,798

DATED : July 14, 1992

INVENTOR(S) : Daniel R. Crum et al

It is certified that error appears in the above-indentified patent and that said Letters Patent is hereby corrected as shown below:

Claim 9, Column 15, Line 11, after the word "defines" delete [;] and insert -- : --.

Claim 21, Column 16, Line 44, after the word "disposed" delete [,].

Claim 23, Column 17, Line 32, "member" should read -- members --.

Signed and Sealed this

Twenty-fifth Day of January, 1994

*Attest:*

*Attesting Officer*

BRUCE LEHMAN

*Commissioner of Patents and Trademarks*